United States Patent [19]

Charpentier

[11] 4,290,439

[45] Sep. 22, 1981

[54] DEVICE FOR CLEANING MECHANICAL PARTS

[75] Inventor: Jean Charpentier, Massy, France

[73] Assignee: Sietam S.A., Viry-Chatillon, France

[21] Appl. No.: 87,037

[22] Filed: Oct. 22, 1979

Related U.S. Application Data

[62] Division of Ser. No. 970,962, Dec. 19, 1978, abandoned.

[30] Foreign Application Priority Data

Dec. 22, 1977 [FR] France ..... 77 38861

[51] Int. Cl.[3] ..... B08B 3/02

[52] U.S. Cl. ..... 134/107; 134/143

[58] Field of Search ..... 134/11-12, 134/31, 105, 107-108, 137, 143, 200

[56] References Cited

U.S. PATENT DOCUMENTS

| | | | |
|---|---|---|---|
| 1,771,698 | 7/1930 | Wolff | 134/105 X |
| 2,732,322 | 1/1956 | Murray | 134/11 X |
| 2,747,590 | 5/1956 | Ipsen | 134/143 X |
| 2,993,493 | 7/1961 | Edhofer | 134/31 X |
| 3,011,924 | 12/1961 | Rand | 134/12 |
| 3,733,710 | 5/1973 | Kearney et al. | 134/11 X |
| 3,896,829 | 7/1975 | Sabatka | 134/143 X |
| 4,038,155 | 7/1977 | Reber | 134/200 X |
| 4,077,467 | 3/1978 | Spigarelli | 134/107 X |
| 4,079,522 | 3/1978 | Ham | 134/11 X |
| 4,186,032 | 1/1980 | Ham | 134/105 X |

FOREIGN PATENT DOCUMENTS

| | | | |
|---|---|---|---|
| 2296025 | 12/1974 | France | 134/200 |
| 548116 | 9/1942 | United Kingdom | 134/11 |

*Primary Examiner*—Robert L. Bleutge

*Attorney, Agent, or Firm*—Sandler & Greenblum

[57] ABSTRACT

A cleaning unit for cleaning mechanical parts and the like with a volatile solvent. The unit comprises a vertically moveable holder for the parts and a lower unit portion including apparatus for washing the parts. An upper unit portion is provided which includes apparatus for drying the parts by cooling. A unit portion is provided which includes apparatus for rinsing the parts. A cover is also provided which is connected to the holder such that when the holder is temporarily immobilized in either the lower unit portion or the unit portion including the rinsing apparatus the cover locks a passage extending between the portion and the portion directly thereabove in a non-sealing relationship.

11 Claims, 2 Drawing Figures

DEVICE FOR CLEANING MECHANICAL PARTS

This is a division of application Ser. No. 970,962, filed Dec. 19, 1978, now abandoned.

BACKGROUND OF THE INVENTION

1. Field of the invention

The invention relates to processing units for cleaning small mechanical parts or assemblies and subassemblies of such parts.

2. Description of Prior Art

Such units are well-known. They all include a cleaning unit formed by a tank in which the parts to be cleaned are subjected to the action of the selected solvent and which is topped by a cooling zone surrounded by water-circulating coils with a peripheral gutter at its base for collecting the condensate.

The cleaning is carried out in three operations: liquid phase washing, rinsing by trickling in the vapor phase and drying by condensation (the latter operation being carried out in the cooling zone).

The parts to be cleaned are arranged in a movable basket guided vertically between the bottom of the tank and an upper point situated abov the cooling zone.

The cleaning agents used are volatile solvents, principally chlorinated solvents (chlorotene, trichloroethylene, etc.) or fluorinated solvents of the fluorocarbon type such as, for example, that known commercially as "Freon" or its azeotropic derivatives. The latter type of solvent is generally preferred when possible since it is practially inert even with respect to synthetic materials whose presence is more and more frequent in mechanical assemblies or sub-assemblies.

For the liquid phase cleaning operation, the solvent is generally in circulation and/or constantly stirred. From this point of view it is possible to distinguish two types of cleaning units.

In the first type, the solvent is projected by nozzles towards the basket containing the articles to be cleaned in the form of horizontal jets distributed over the whole height of the basket, the basket and the nozzles being in relative rotation. The solvent is removed from the bottom of the tank to the reservoir and passed through a filtering device. Thus, the tank is completely empty after liquid phase cleaning by sprinkling and the vapor phase rinsing can be effected without moving the basket. The cooling zone is arranged immediately above the tank and by raising the basket again into this zone, drying by evaporation is effected.

In a second type, the cleaning is effected by immersion. The tank is constantly filled with liquid solvent kept in constant circulation by a pump arranged on a pipe connecting a filling orifice (situated generally at mid-height of the tank), on the one hand, and two removal orifices, on the other hand, one for overflow at the top part and the other part for draining at the bottom part. Of course, a filtering device is placed in said the pipe. In addition, the solvent may be subjected to stirring means arranged at the bottom of the tank, which means can be ultrasonic (magnetostriction transducers or ferroelectric ceramic), mechanical (blade stirrer) or dynamic (pulsed air). In this case, the vapor phase rinsing is effected above the level of the liquid after having re-raised the basket into an intermediate zone situatued between the tank proper and the cooling zone.

In all cases, the passage into vapor phase is intended above all to occur on rinsing by trickling but also serves for reheating the cleaned parts in order to facilitate the speed of evaporation when they pass into a cold zone and thus to obtain better drying. In spite of this, mostly, solvent droplets are retained in certain hollows of the parts to be processed. This solvent retention presents a triple drawback. On the one hand, the rinsing is incomplete at the level of these hollows and impurities can persist there which can be serious where precision parts are concerned. On the other hand, it involves an increase in the consumption of solvent which is still an expensive material. Finally, reasons of hygiene and safety require the removal as completely as possible of the solvent.

SUMMARY OF THE INVENTION

In order to overcome these drawbacks in facilitating rinsing by trickling, by raising the temperature of the parts above the boiling point of the solvent (complete and faster evaporation) and by causing greater thermal shock between the solvent and the cooling zone in order to reduce the level of consumption, the invention provides for the use of the superheated vapor of a selected solvent in the rinsing phase.

Of course, a solvent must be selected whose boiling point is sufficiently low so that the temperature of its superheated vapor does not result in any distortion of the most sensitive of the parts or sub-assemblies to be cleaned. In this respect, the above-mentioned fluorinated solvents whose boiling points are below 50° C. enable superheating of the vapor for example, at a temperature of the order of 80° C. which is quite sufficient for the desired result and without risking distortion of elements made out of of synthetic materials.

This superheated vapor rinsing process is very important since it enables cleaning, without appreciable retention of solvent, of sub-assemblies which can have nests or multiple connections. In this way the number of parts to be disassembled (and hence to be reassembled afterwards) is considerably reduced, which results in a considerable gain in time and consequently, appreciable economy of labor.

The rinsing with superheated vapor can be adapted to the two above-mentioned types of cleaning units, without any difficulty, by arranging in a conventional installation, a superheater between the conventional vapor generator and the vapor inlet pipes in the tank.

Generally the basket is secured by to a "cover" which is more or less thick and arranged above it and designed to close the passage between the part of the cleaning unit in which the basket is temporarily immobilized and the upper part of the unit. That is to say in the first type of unit (jet washing) the cover separates the tank from the cooling zone when the basket is in the lowered position, and in the second type (immersion washing) the cover separates the tank from the intermediate rinsing zone when the basket is in the lowered position, then separates the intermediate zone from the cooling zone when the basket is in the rinsing position. However, of course, it cannot be a fluid-tight separation, as the vapor must be able to escape (from the tank or from the intermediate zone) and be recovered by condensation in contact with cooling coils which are generally bladed coils. A certain clearance must hence be arranged provided over the whole periphery of the cover. In order to avoid too great a solvent loss (uncondensed vapor), it is also an object of the invention to provide a cleaning unit of one or other of the above-mentioned types, characterized in that the cover is constituted by a plug having an upper portion of cross-section close to that of the cooling zone inside the turns of the coil and a lower or frustoconic or frustopyramidal portion, as the case may be, whose small base forms the lower surface of the plug, the plug being arranged with respect to the basket so that said lower surface is substantially at the level of the base of the cooling zone when the basket is in the rinsing position.

Thus, the escape of vapor is directed automatically towards the coil and the losses are low.

BRIEF DESCRIPTION OF THE DRAWINGS

The invention will be better understood on reading the following description in conjunction with the drawings of embodiments thereof, given purely by way of non-limiting example. In the drawing.

DETAILED DESCRIPTION OF THE DRAWINGS

Figure 1:
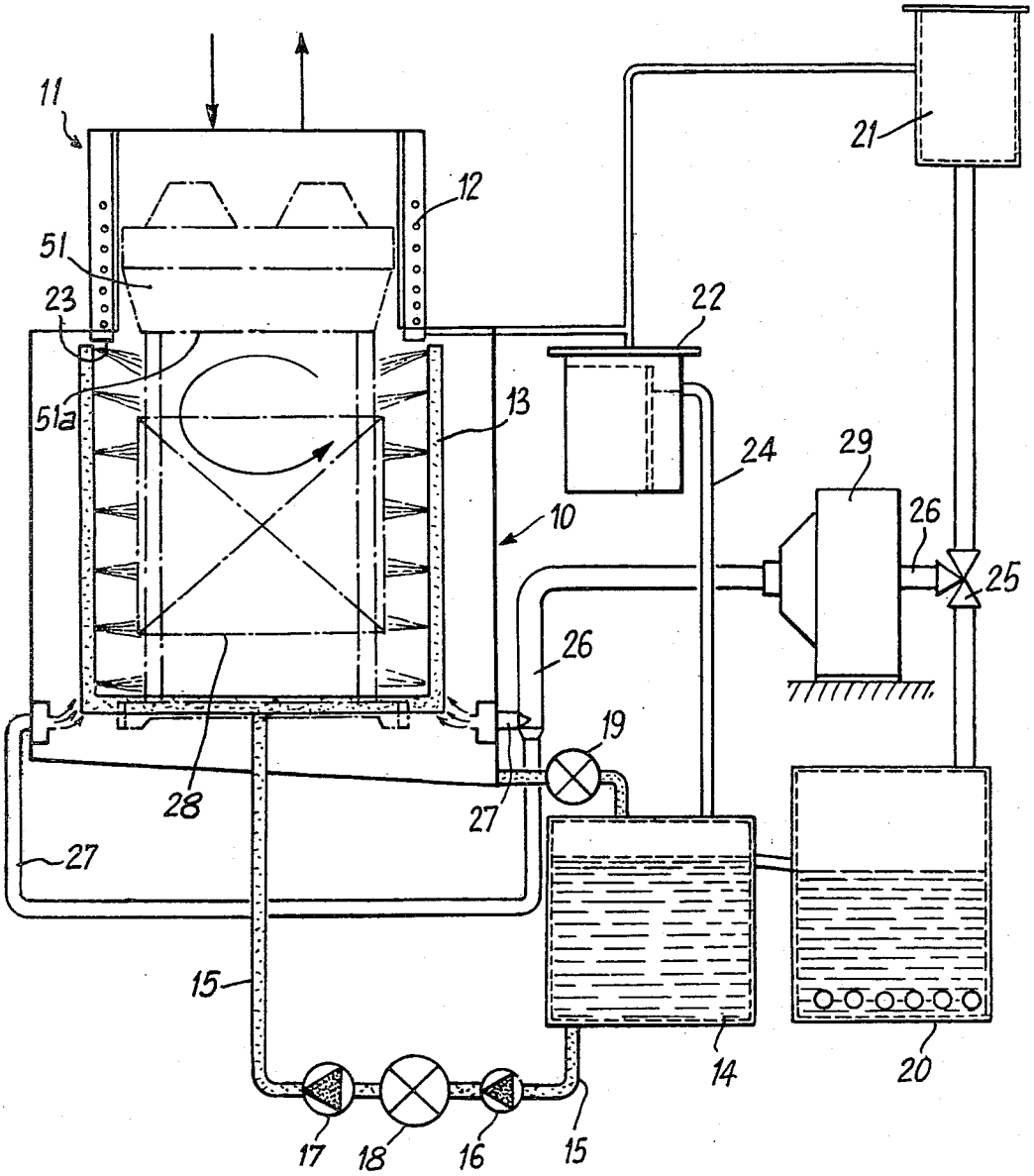
FIG. 1 is a diagrammatic section of a cleaning unit with solvent jet washing (or washing by sprinkling)

In FIG. 1 an embodiment of a cleaning unit according to the invention traditionally includes a tank 10 beneath by a cooling zone 11 surrounded by a coil 12 (preferably with blades). Inside the tank is a turnstile 13 with a vertical axis including at least two vertical arms of substantially equal height to that of the tank. On the vertical arms are distributed substantially horizontal spray nozzles. The turnstile is supplied with solvent from a reservoir 14 by a pipe 15 on which are arranged a low pressure pump 16 and a high pressure pump 17. Between the pumps 16 and 17 is inserted a filter 18.

The bottom of the tank 10 is inclined and the solvent sprayed by the nozzles returns by gravity to the reservoir 14 by passing through a filter 19. The reservoir 14 receives at intervals clean solvent through a circuit (not shown) (if necessary including an auxiliary reservoir) and its overflow pours by gravity into a vapor generator 20 capped by a condenser 21. Also conventionally, a water separator 22 (of the Florentine vase or similar type) is connected, on the one hand, to the condenser 21 and, on the other hand, to a peripheral gutter 23 arranged at the base of the cooling zone. The solvent coming from the separator 22 returns to the reservoir 14 through pipes 24 whilst the water is removed to the drain by a pipe (not shown). By means of a valve 25 with two exits, the vapor produced by the generator 20 can be directed to the condenser 21 or into a main pipe 26 to be blown to the lower part of the tank 10 through secondary piping 27. A cage and lifting means (not shown) enable a basket or holder 28 (shown in mixed lines) for receiving the parts to be cleaned, to be raised and lowered in the axis of the tank 10 and the cooling zone 11.

All these arrangements are conventional and the cleaning operations are carried out as has een previously described by:

positioning of the parts to be cleaned in the holder 28 brought into the upper position;

lowering of the basket into a lower unit portion;

spraying of liquid solvent by the turnstile by operating pumps 16 and 17;

stopping the pumps 16 and 17 and opening the valve 25 to the piping 26 to bring the vapor stream into the tank, whence rinsing of the parts by trickling;

manipulating the valve 25 to direct the vapor to the condenser 21 and;

raising the basket 28 again into an upper unit portion constituting the cooling zone 11 for drying by evaporation.

Very generally, to avoid any soiling of the solvent and to avoid at the same time pollution of the surrounding air, the various cycles of operations of this processing unit are controlled and programmed automatically.

According to the invention a superheater 29 placed in the main pipe 26 enables the temperature of the vapor to be raised from 20° to 30° C. This superheating facilitates rinsing by trickling, it raises the temperature of the parts above the boiling point of the solvent and thus increases the speed of evaporation of the solvent which cold be retained in certain cavities of the processed parts, and, finally, it increases the magnitude of the thermal shock between the solvent and the sheath of the cooling zone, which results in a decrease in solvent consumption.

Figure 2:
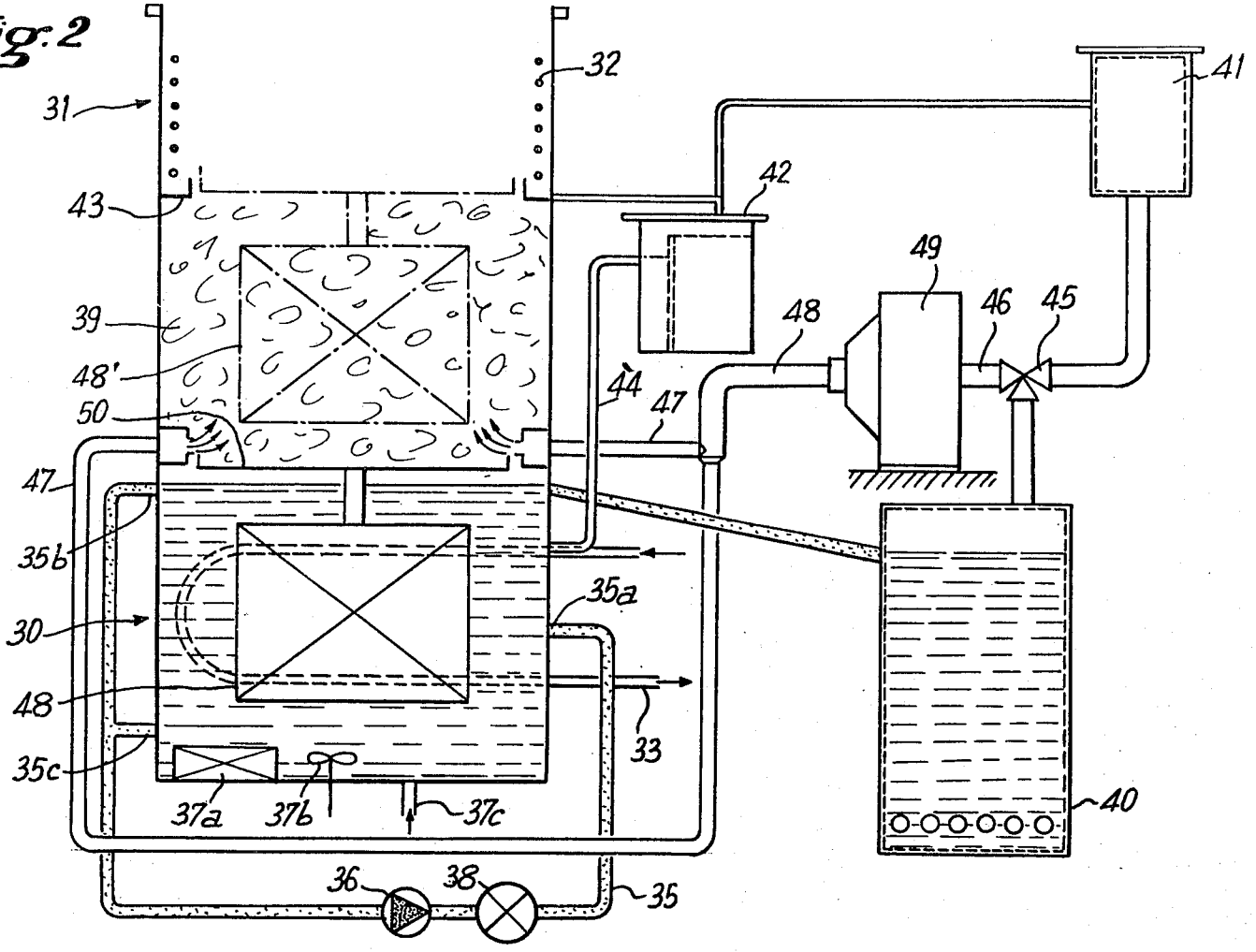
FIG. 2 is a diagrammatic section of a cleaning unit with washing by immersion.

In FIG. 2, which shows diagrammatically a cleaning unit with immersion washing, there is again a tank 30 capped by an upper unit portion in the form of a cooling zone 31 with its coil 32. Here it is the tank itself which plays the role of reservoir and which feeds by gravity a vapor generator 40 with its double outlet valve 45 and its condenser 41. In the same way there is again a water separator 42 connected to the condenser 41 and a recovery gutter 43 for the condensate from the cooling zone 31. The liquid solvent circuit includes a pipe 35 with a supply inlet **35*a* at the mid-height of the tank, an overflow outlet 35*b* at the top part and an evacuation outlet 35*c* at the bottom part. In the pipe 35 are arranged a pump 36 and a filter 38. Of course, the tank is also supplied intermittently by a solvent inlet (not shown) adapted to compensate for losses. A stirring device for the solvent is placed at the bottom of the tank. This device can be a battery 37*a* of ultrasonic transducers, a bladed stirrer 37*b* or a pulsed air nozzle 37*c*. A cooling circuit 33** dips into the solvent.

The tank comprises, between the upper level of the solvent (overflow level) and the cooling zone 31 (upper unit portion), a unit portion 39 into which the basket 48 is raised (at 48') for the vapor phase rinsing operation. That is to say the secondary vapor pipes 47 coming from the main pipe 46, open into the lower part of the rinsing unit portion, slightly above the level of the liquid solvent.

Thus, in the course of cleaning, the holder 48 occupies three positions: a low position in the lower unit portion for the immersion washing operation, a middle position in the rinsing unit portion for the trickling rinsing operation and an upper position for the drying operation.

Here again a superheater 49 is placed in the main vapor pipe 46.

In conventional manner, as shown in FIG. 2, the holder is capped by a cover 50 which, at each position of the holder, separates the portion containing the holder from the portion immediately above. This separation cannot be fluid-tight since when the basket is at 48', in order to receive the vapor phase, it is necessary to provide for an escape of vapor to the cooling zone in the upper portion.

According to the invention, in order to decrease solvent consumption by reducing losses arising from the vapor escaping on condensation, the cover is constituted by a thick plug such as 51 shown in mixed lines in FIG. 1. The upper part of the plug has a cross-section approximating that of the zone 11 inside the turns of the coil 12. The lower part of the plug 51 is frustoconic or frustopyramidal and its small base 51*a* constitutes the lower surface of the plug. The assembly is arranged so that this lower surface 51*a* is substantially at the level of the gutters 23, 43 when the basket is in rinsing position (lower position in FIG. 1, middle position 48' in FIG. 2). Thus, the vapor moving outwardly and passing around the plug is sent back towards the cooling coil.

I claim:

1. A cleaning unit for cleaning mechanical parts, assemblies and sub-assemblies thereof with a volatile solvent, said unit comprising:

(a) a vertically moveable holder for said parts;

(b) a lower unit portion including means for washing said parts;

(c) an upper unit portion including means for drying said parts by cooling;

(d) a unit portion including means for rinsing said parts by supplying superheated vapor into a base of said unit portion including means for rinsing; and (e) a cover on top of said vertically moveable holder such that when said holder is temporarily immobilized in either said lower unit portion or said unit portion including means for rinsing, said cover partly closes a passage extending between said portion in which said holder is temporarily immobilized and the portion directly thereabove in a non-sealing relationship.

2. A cleaning unit in accordance with claim 1 wherein said drying means comprises a cooling coil having turns and a base and defining a cooling zone and said cover comprises a plug with a cross section close to the cross section of said cooling zone, said plug also having a lower surface, said lower surface being situated substantially at the level of said cooling zone base when said moveable holder is washed and when said moveable holder is rinsed.

3. A cleaning unit in accordance with claim 2 wherein said plug lower surface is frustoconical.

4. A cleaning unit in accordance with claim 2 wherein said plug lower surface is frustopyramidal.

5. A cleaning unit in accordance with claim 1 further comprising a tank.

6. A cleaning unit in accordance with claim 1 wherein said washing means comprises a turnstile with vertical arms and horizontal spray nozzles.

7. A cleaning unit in accordance with claim 1 wherein said lower unit portion and said unit portion including rinsing means are the same portion.

8. A cleaning unit in accordance with claim 1 wherein said drying means comprises a cooling coil having turns and a base and defining a cooling zone and said cover comprises a plug having a generally flat surface, said plug being positioned adjacent to said rinsing unit portion when the moveable holder is being washed and adjacent the level of said cooling zone base when said moveable holder is being rinsed.

9. A cleaning unit in accordance with claim 1 further comprising a tank for holding solvent and for immersing said moveable holder and means for stirring said solvent.

10. A cleaning unit in accordance with claim 1 wherein said unit portion including means for rinsing is an intermediate portion located between said upper unit portion and said lower unit portion.

11. A cleaning unit in accordance with claim 1 wherein said cover is adapted to direct vapor escaping from said holder when in said unit portion including means for rinsing said parts towards cooling means in said upper unit portion.

* * * * *

UNITED STATES PATENT AND TRADEMARK OFFICE

CERTIFICATE OF CORRECTION

PATENT NO. : 4,290,439

DATED : September 22, 1981

INVENTOR(S) : Jean CHARPENTIER

It is certified that error appears in the above—identified patent and that said Letters Patent is hereby corrected as shown below:

Column 2, line 49, "to" should be deleted.

Column 3, line 29, "by" (first occurrence) should be deleted.

Column 4, line 18, "cold" should be --could--.

Signed and Sealed this

*Second* Day of *March 1982*

[SEAL]

*Attest:*

GERALD J. MOSSINGHOFF

*Attesting Officer* *Commissioner of Patents and Trademarks*